US007726090B2

(12) United States Patent
Verelli et al.

(10) Patent No.: US 7,726,090 B2
(45) Date of Patent: Jun. 1, 2010

(54) WHEEL SPACER FOR REINFORCING RODS OF CEMENTITIOUS STRUCTURES

(75) Inventors: Angelo Verelli, Lasalle (CA); Carlo Verelli, Lasalle (CA)

(73) Assignee: C.V. International Plastics Inc., Lasalle, Quebec (CA)

( * ) Notice: Subject to any disclaimer, the term of this patent is extended or adjusted under 35 U.S.C. 154(b) by 340 days.

(21) Appl. No.: 12/003,431

(22) Filed: Dec. 26, 2007

(65) Prior Publication Data

US 2009/0165418 A1 Jul. 2, 2009

(51) Int. Cl.
*E04C 5/16* (2006.01)
*E04C 3/00* (2006.01)
*E04G 21/12* (2006.01)

(52) U.S. Cl. ..... 52/649.8; 52/673; 52/583.1; 52/677; 52/689; 52/DIG. 2

(58) Field of Classification Search ..... 52/649.8, 52/649.7, 677, 678, 680, 689, 673, 583.1, 52/584.1; 404/135, 136; D8/384; 248/74.2
See application file for complete search history.

(56) References Cited

U.S. PATENT DOCUMENTS 3,300,930 A * 1/1967 Weise ..... 52/309.1
3,348,347 A * 10/1967 Berry ..... 52/309.1
3,694,989 A 10/1972 Oliver et al.
3,830,032 A * 8/1974 Robb ..... 52/687
3,913,187 A * 10/1975 Okuda ..... 24/484
5,313,757 A * 5/1994 Schnepf ..... 52/301
5,347,787 A * 9/1994 Gavin ..... 52/677
5,542,785 A * 8/1996 Cloud ..... 405/239
6,367,556 B1 * 4/2002 Moore ..... 166/378
7,017,867 B2 * 3/2006 Sono ..... 248/74.1

* cited by examiner

*Primary Examiner*—David Dunn
*Assistant Examiner*—Joseph J Sadlon
(74) *Attorney, Agent, or Firm*—Equinox Protection; Franz Bonsang, Patent Agent

(57) ABSTRACT

A wheel spacer is provided for spacing a reinforcing rod for a cementitious structure away from an object during fabrication of the structure. The spacer consists of two substantially semicircular sections configured for connection together with the rod abuttingly retained in saddles generally situated at the center of the sections when connected together in an assembled configuration for the spacer. Each section has, on an inner wall thereof in which the saddles are situated, primary inserting arms for insertion into apertures for locking engagement with teeth on the inserting arms with teeth on receiving arms of the other section. Retaining arms having guide walls further facilitate retention of the rod and guiding thereof towards the saddles while the spacer is placed in the assembled configuration.

15 Claims, 4 Drawing Sheets

WHEEL SPACER FOR REINFORCING RODS OF CEMENTITIOUS STRUCTURES

FIELD OF THE INVENTION

The present invention relates to spacers for spacing reinforcing structures during manufacture of cementitious structures, and is more particularly directed to a wheel spacer for spacing a reinforcing rod for a cementitious structure relative to an object during manufacture of the cementitious structure.

BACKGROUND OF THE INVENTION

Wheel spacers for positioning or spacing reinforcing rods which reinforce cementitious structures relative an object, such as a mold or wall containing the structure, during the manufacture of the structure are well known in the art. Such wheel spacers typically are circular in form on an outer wall thereof and have an inner saddle formed by an inner wall thereof in which the rod is held. The rod, seated in the saddle, is spaced from the object by abutment of the outer wall against the object.

For example, U.S. Pat. No. 3,694,989 teaches a wheel spacer having a saddle for the rod essentially at the center thereof, relative the outer wall which abuts the object for spacing the rod therefrom. The rod is held in place in the saddle by a locking member which is slid into a groove, via a gap in the outer wall, leading into the saddle. Unfortunately, if equal and uniform spacing of each rod relative the object is desired, due to the gap in the outer wheel, each wheel spacer of this type must be positioned carefully with regard to every other wheel spacer of this type to ensure that either the gap abuts the object or the solid circular part of the spacer abuts the object. Otherwise, different rods in the structure may not be equally spaced relative the object.

U.S. Pat. No. 5,542,785 discloses a wheel spacer which partially circumvents the aforementioned difficulty. The spacer consists of two largely symmetrical and semicircular sections which each have a respective saddle extending on an inner wall thereof towards the respective outer wall thereof. Thus, the rod may be placed or aligned with one of the saddles of one section and then sections connected together in abutment with one another, notably the outer walls thereof. Thus, the rod is held in the saddles and there is no substantially gap in between the outer walls. Unfortunately, the attachment members by which the two sections are attached, essentially arms having single protrusions or clips on the ends thereof, allow for little adjustment of the space provided by the saddle, and thus the size of the rod held thereby. Further removal of the rod, which may be occasionally desired prior to manufacture of the rod, may be rendered difficult as the attachment members may make separating of the attachment members difficult. Further, and inconveniently, the rod must be precisely positioned in one of the saddles prior to attachment of the sections together as there is no means provided for retaining and guiding the rod into the saddles as the sections are being connected.

U.S. Pat. No. 5,347,787 discloses a single piece wheel spacer having two sections joined by a hinged portion on the outer wall, and which obviates some of the aforementioned difficulties by providing retaining arms which guide the rod towards the saddles. However, as the two sections of the wheel spacer are permanently attached to one another at the hinged portion, the wheel spacer may, in some circumstances where space is limited, be difficult to place around the rod. Further, removal of the spacer from the rod in the event that repositioning of the spacer is desired, for example before apply cementitious material for manufacture of the cementitious structure may be encumbered due the connection of the sections at the hinged portion. In addition, during seating of the rod in the saddles, there is always a risk that the rod will fall between the saddles and the hinged portion which may break the hinged portion or require lifting of the rod back into alignment with the saddles.

Accordingly, there is a need for an improved wheel spacer for spacing a reinforcing rod during manufacturing of a cementitious structure.

SUMMARY OF THE INVENTION

It is therefore a general object of the present invention to provide an improved wheel spacer for spacing a reinforcing rod during manufacturing of a cementitious structure.

An advantage of the present invention is that the wheel spacer guides the rod into position in the saddles.

Another advantage of the present invention is that the wheel spacer retains the rod in proximity to the saddles during seating of the rod in the spacer.

A further advantage of the present invention is that, once the rod is seated ion the spacer, the spacer is held securely and stably in place thereupon.

In one aspect of the present invention, there is provided a wheel spacer for mounting on a rod used in concrete item manufacture for spacing the rod from an object, the spacer comprising:

two sections, each section having a respective outer wall and a respective inner wall, the respective inner wall having respective first and second ends, a saddle situated substantially centrally between the respective first and second ends and extending towards the respective outer wall, and first and second wall portions connected by the respective saddle and extending therefrom respectively to the respective first and second ends, the respective outer wall extending generally circularly from the respective first end to the respective second end and forming a generally circular outer wheel structure when the first and second sections are connected to one another;

at least one primary inserting arm having primary inserting arm teeth protruding therefrom and extending from at least one of the respective first and second wall portions of one of the sections outwardly away from the respective saddle and the respective outer wall thereof;

for each primary inserting arm, on another of the sections, a respective primary arm aperture situated on the respective inner wall and a respective primary receiving arm, having primary receiving arm teeth, extending therefrom in proximity to the respective primary inserting arm aperture towards the respective outer wall thereof, the respective primary arm aperture and the respective primary receiving arm being respectively situated on the respective first or second wall portion when the inserting arm is situated on the respective second or first wall portion, the respective primary arm aperture, the respective primary receiving arm, the primary inserting arm teeth and the primary receiving arm teeth being configured for insertion of the primary inserting arm through the respective primary arm aperture with the primary inserting arm teeth and the respective primary receiving arm teeth releasably lockingly engaging each other to connect the sections together with the rod grippingly retained by the saddles and the outer wheel structure abutting the object to space the rod relative thereto at a substantially equal distance regardless of a position at which the object abuts the outer wheel structure.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiments of the present invention will be herein described for indicative purpose and by no means as of limitation.

Figure 1:
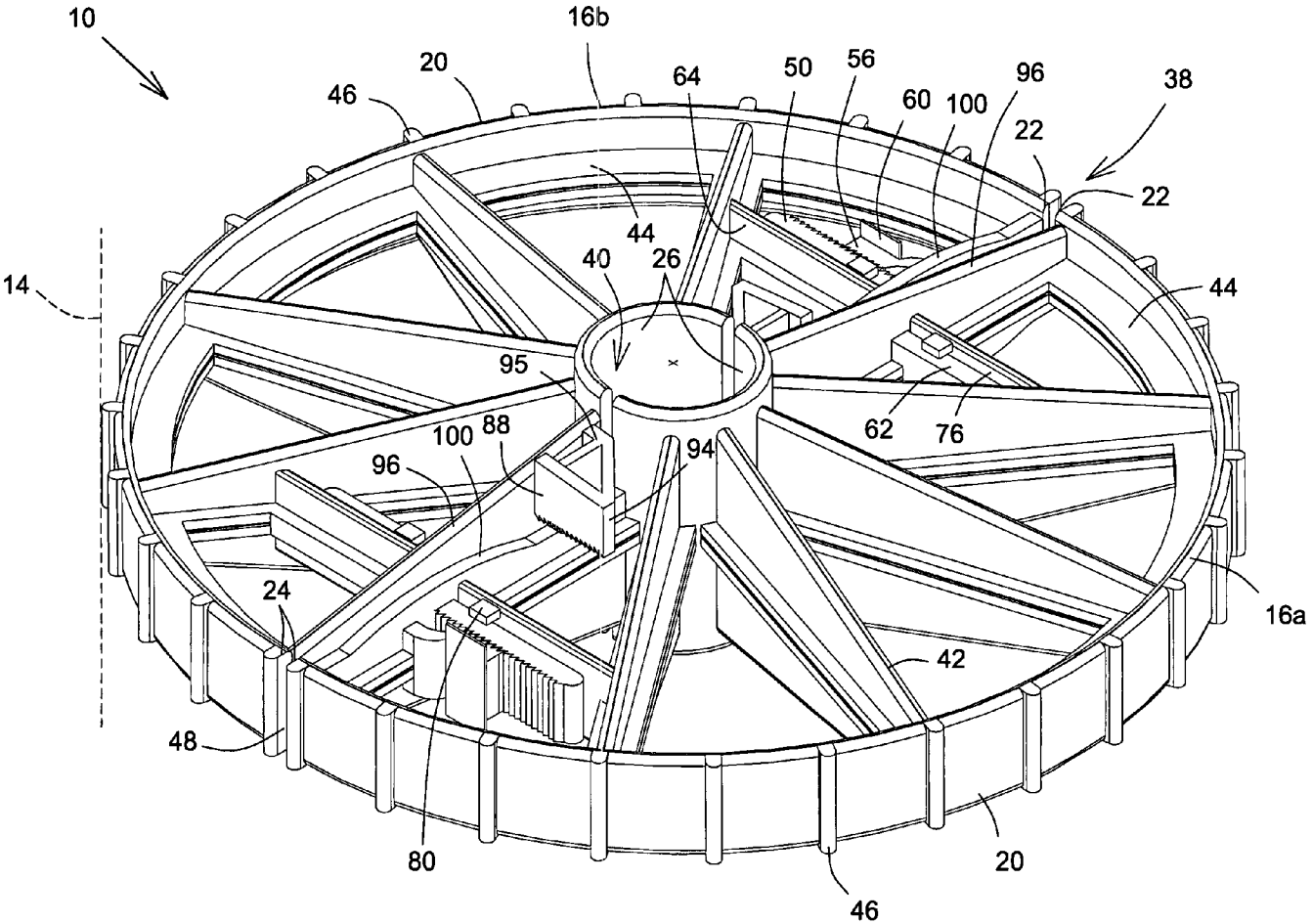
FIG. 1 is a perspective view of a wheel spacer, shown in a connected configuration, for mounting on a rod used in concrete item manufacture for spacing the rod from an object in accordance with an embodiment of the present invention.
Figure 2:
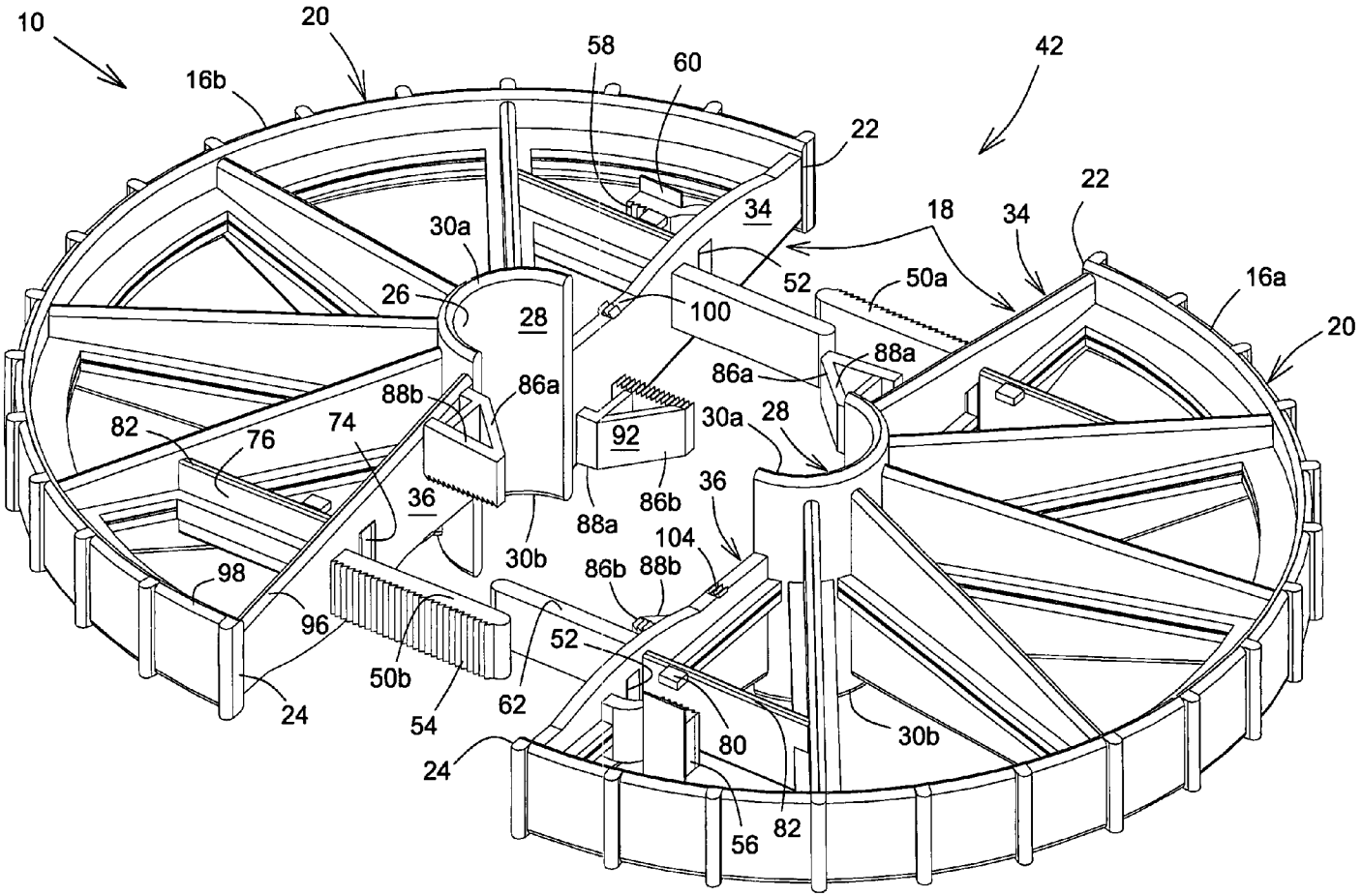
FIG. 2 is a side perspective view of the wheel spacer, shown in a disconnected configuration, illustrated in FIG. 1.
Figure 3:
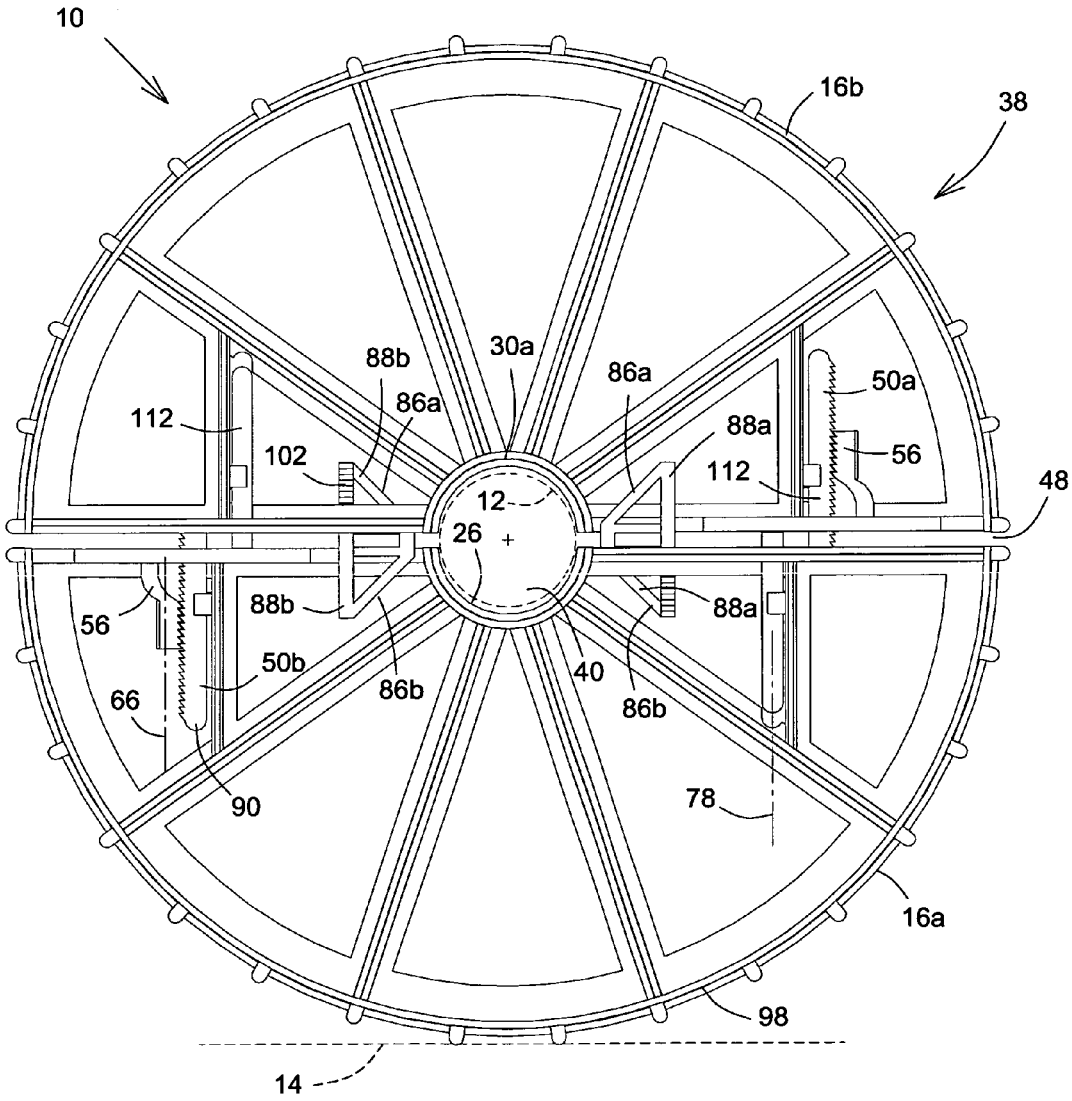
FIG. 3 is a top view of the wheel spacer illustrated in FIG. 1, shown in the connected configuration.
Figure 4:
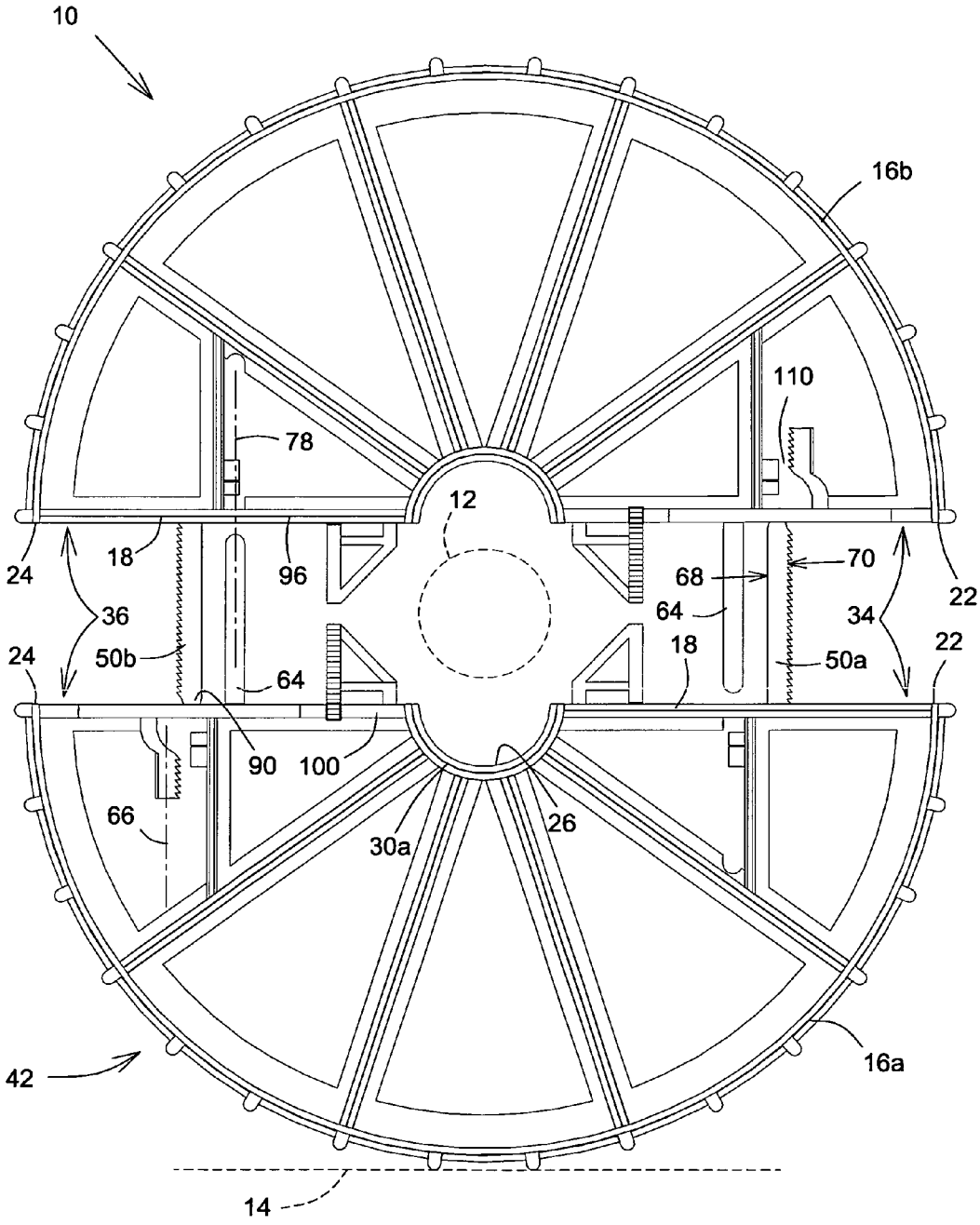
FIG. 4 is a top view of the wheel spacer illustrated in FIG. 1, shown in the disconnected configuration.

Referring now to FIGS. 1 through 4, therein is shown a wheel spacer, shown generally as 10, for seating or otherwise mounting a reinforcing rod 12, shown in dotted lines in FIG. 1, 3, and 4, for use in manufacture of a cementitious structure by spacing the rod 12 from an object 14, typically a mould for the structure or a wall or barrier within which the cementitious material is distributed, in accordance with an embodiment of the present invention. One skilled in the art will appreciate that the cementitious structure may be of any type or form for which reinforcing rods 12 are typically used. Further, it will be apparent to one skilled in the art that the cementitious material may be of any type, such as concrete, cement, plaster, or the like, and may include reinforcing materials, such as weaves and wire, metal, or fiber matrices, netting, sheets or the like. The spacer 10 itself is, preferably, constructed of rigid, durable plastic material. However, one skilled in the art will appreciate that the spacer 10 may be constructed of any other durable rigid durable material, for example metal or the like, capable of supporting and spacing the rod away from the object once the cementitious material is applied during manufacture of the structure.

As shown, the spacer 10 has a first and second sections 16*a*, 16*b*, essentially identical and mirror images of one another. Each section 16 is generally semi-circular in shape and has a respective outer wall 20 and a respective inner wall 18, the outer wall extending circularly from a respective first end 22 and respective second end 24 of the inner wall 20, thus giving the section 16 its substantially generally semi-circular shape.

Each inner wall 18 has a, preferably semi-circular, recessed respective saddle 26 for placement, i.e., seating or mounting of the rod 12, in abutment therewith. Each saddle 26 extends from the inner wall 18 towards the outer wall 20 between a respective first wall portion 34 and a respective second wall portion 36, preferably of equal length, of the inner wall 18. The first and second wall portions 34, 36 extend from the saddle 26, respectively, to the respective first end 22 and respective second end 24 of the inner wall 18.

The saddle 26 is defined, i.e. formed, by a respective saddle wall 28 which extends preferably semi-circularly between the respective wall portions 34, 36, i.e. from the first wall portion 34 to the second wall portion 36 towards the outer wall 20, along generally opposed respective first and second saddle edges, respectively 30*a*, 30*b*. Accordingly, the saddle 26 is preferably situated substantially centrally between the ends 22, 24. Further, the respective saddles 26 of the sections 16 are preferably identical in size and shape and situated at the same position between the respective first and second ends 22, 24 thereof. Thus, the saddles 26 are at the centre of the spacer 10 and form a generally centrally situated cradle 40 for retaining the rod 12 by abutment thereof against the saddle walls 28 when the spacer 10 is placed in an assembled configuration, shown generally as 38 in FIGS. 1 and 3, in which the sections 16 are connected together with the respective inner walls 18 proximally adjacent one another, with only a minimal space 48 therebetween. Further, in the assembled configuration 38, the respective first ends 22 are circumferentially aligned with one another, as are the respective second ends 24, such that the respective outer walls 20 together form a generally circular outer wheel structure. As the saddles 26, and thereby the cradle 40, in which the rod 12 are abuttingly held, are centrally situated within the spacer 10 when in the assembled configuration 38, the rod 12 will be placed at substantially the same distance from the object 14, regardless of the position at which the outer wall 20 of either section 16, i.e. the outer wheel structure, and the object 14 abut.

To provide reinforcement of the outer wall 20, and more specifically the position thereof relative the saddle 26 and rod 12, each section 16 has at least one radial support arm 42 extending radially outwardly from the saddle 26 to the outer wall 20 thereof. Preferably, each section 16 will have a plurality of radial support arms 42, preferably substantially equally spaced apart from one another. Preferably, to provide additional support, notably for the radial support arms 42, there is at least one lateral support arm 44 that extends radially from each radial support arm 42 to either an adjacent lateral support arm 44 adjacent thereto or to an inner wall 18 adjacent thereto. Preferably, the lateral support arm 44 will extend in alignment with the arc formed by outer wall 20. To provide traction against the object 14, the outer wall 20 has at least one protrusion 46, and preferably a plurality of protrusions 46. The protrusions 46 are preferably equally circumferentially spaced apart on the outer wall 20, extending outwardly therefrom away from the saddle 26. The protrusions 46 also provide additional spacing from object 12 and thus minimize effects of the space 48 between the sections 16 on the spacing of the rod 12 from the object 14.

Referring still to FIGS. 1, 2, 3, and 4, the features of the spacer 10 relative to deployment thereof from a disassembled configuration, shown generally as 42 in FIGS. 2 and 4, into the assembled configuration 38 are now explained. As shown in FIGS. 2 and 4, when the spacer 42 is in the disassembled configuration 42, the sections 16 are disconnected, i.e. detached, from one another and the rod 12. When the spacer 10 is in the assembled configuration 38, the sections 16 are connected to one another with the inner walls 18 situated adjacently proximal one another, the first ends 22 and second ends 24 of the sections 16 respectively circumferentially aligned, and the rod 12 grippingly engaged in the saddles 26 by abutment against the saddle walls 28 thereof.

The sections 16 are connected, i.e. attached together by one or more, and preferably at least two, primary inserting arms 50 having primary inserting arm teeth 54. Each primary inserting arm 50 extends, preferably perpendicularly, from either one of the respective first and second wall portions 34, 36 of a section 16 and outwardly away from the respective saddle 26 and outer wall 20 thereof. For each primary inserting arm 50 on one section 16, there is a respective primary aperture 52 situated on the other section 16 on the same respective wall portion 34 of the respective inner wall 18 thereof as the primary inserting arm 50 therefor. Accordingly, if there is a primary inserting arm 50 on the first wall portion 34 or second wall portion 36 of one section 16, there is a respective primary aperture 52 therefor on, respectively, the first wall portion 34 or second wall portion 36 of the other section 16.

For each primary inserting arm 50 on each section 16 there is also a respective primary receiving arm 56, having primary receiving arm teeth 58, on the other section 16. The primary receiving arm 56 extends, preferably perpendicularly, from the wall portion 34, 36 where the respective primary aperture 52 is situated, proximally adjacent the respective primary aperture 52 and towards the respective outer wall 20 of the section 16. The respective primary aperture 52 is preferably situated between the respective primary receiving arm 56 and the saddle 26. Further, the arms 50, 56, teeth 54, 58 and primary aperture 52 are configured for insertion of the primary inserting arm 50 through the respective primary aperture 52 therefor with the teeth 56, 58 releasably lockingly engaging one another to securely and releasably connect the sections 16 together in the assembled configuration 38 with the rod grippingly engaged in the saddles 26 and the object 14 and the outer walls 20 abutting one another. As shown in FIG. 1, the teeth 54, 58 are configured, i.e. positioned, facing one another to provide the releasable locking engagement. To release, i.e. disconnect, the sections 16, and thus return the spacer 10 to the disassembled configuration 42, the arms 50, 56 are pulled away from one another, such that the teeth 54, 58 disengage from one another, preferably by moving the release tab 60 of the primary receiving arm 56 away from the primary inserting arm 50. Once the teeth 54, 58 are disengaged, the sections 16, can then be pulled away from one another to separate the sections 16 and return the spacer 10 to the disassembled configuration 42.

To provide more secure connection of the sections 16, the spacer 10 has, preferably, two primary inserting arms 50*a*, 50*b*. Preferably, and as shown in FIGS. 1 to 44, a first primary inserting arm 50*a* extends from the first wall portion 34 of one section 16*a* and a second primary inserting arm 50*b* extends from the second wall portion of the other section 16*b*. However, if desired, both primary inserting arms 50*a*, 50*b* could extend from, respectively, the first and second wall portions 34, 36 of the same section 16*a* or 16*b*. In either case, the teeth 54, 58, and respective primary receiving arms 56 are configured as described above. Further, while the primary receiving arm teeth 58 are shown as being oriented facing towards the saddle 26, with the primary inserting arm teeth 54 facing away therefrom, the orientation of the teeth 54, 58 face could be reversed, provided the positions of respective primary receiving arm 56 and the respective primary aperture 52 for the primary inserting arm 50 are similarly reversed. In such case, the primary receiving arm 56 would, therefore, be situated between the primary aperture 52 and the saddle 26.

To provide increased stability, the spacer 10 preferably has one or more optional secondary inserting arms 62, each secondary inserting arm 62 having a respective secondary aperture 74 therefor. Preferably, and as shown in FIGS. 1 to 4, for each primary inserting arm 52 extending from the first or second wall portion 34, 36 of one section 16, there is a respective secondary inserting arm 62 extending, preferably perpendicularly, from the corresponding first or second wall portion 34, 36 of the other section 16 and away from the saddle 26 thereof. For each secondary inserting arm 64 on one section 16, there is a respective secondary aperture 74 configured for snugly receiving and passing of the secondary inserting arm 62 therethrough on the corresponding wall portion 34, 36 of the other section 16. Thus, for each primary inserting arm 50 on the first wall portion of one section 16, there is a respective secondary aperture 74 on the first wall portion 34 of that section 16 and a respective secondary inserting arm 62 on the first wall portion 16 of the other section 16. Similarly, for each primary inserting arm 50 on the second wall portion 36 of one section 16, there is a respective secondary aperture 74 on the second wall portion 36 of that section 16 and a respective secondary inserting arm 62 on the second wall portion 36 of the other section 16. Each secondary inserting arm 62 and respective secondary aperture 74 therefor are configured for insertion of the secondary inserting arm 62 through the secondary aperture 74 as the primary inserting arm 50 is inserted through the respective primary aperture 52 to connect the sections 16 together to put the spacer 10 in the assembled configuration 38. Advantageously, the secondary inserting arm 62 provides additional support and reinforcement against movement of the sections 16 relative one another when the spacer 10 is in the assembled configuration 38 and provides enhanced stability for the spacer 10 and the positioning of the rod 12 relative the object 14.

To provide further reinforcement and stabilization of the spacer 10 against movement of the sections 16 relative one another, the spacer 10 preferably has, for each primary inserting arm 50, a respective primary stabilizing arm 64. The respective primary stabilizing arm 64 extends from the inner wall 18 of the section 16 having the respective primary receiving arm 56 and aperture 52 for the primary inserting arm 50, notably the wall portion 34, 36 upon which the primary receiving arm 56 and aperture 52 are situated. Specifically, the primary stabilizing arm 64 extends, preferably perpendicularly or in axial alignment with a first axis 66 defined by the primary receiving arm 56. The primary stabilizing arm 64 is configured, for example positioned, sized and shaped, to adjacently abut the primary inserting arm 50 on a respective first primary inserting arm side 68 thereof while the primary inserting arm 50 is lockingly engaged on a generally opposed second primary inserting arm side 70 thereof by the primary receiving arm 56. Accordingly, the primary stabilizing arm 64 limits the motion of, thereby stabilizing, the primary inserting arm 50 by forming a primary stabilizing channel 110, along with the primary receiving arm 56 and aperture 52, in which the primary inserting arm 50 is extended in abutting engagement with arms 56, 64 for the assembled configuration 38.

Similarly, to provide stabilization for the secondary inserting arms 62, there is a secondary stabilizing arm 76 to provide further reinforcement and stabilization of the spacer 10 against movement of the sections 16 relative one another. The spacer 10 preferably has, for each secondary inserting arm 62, one respective secondary stabilizing arm 76 therefor. The respective secondary stabilizing arm 76 extends from the inner wall 18 of the section 16 having the respective secondary aperture 74 therefor, notably the wall portion 34, 36 upon which the aperture 74 is situated. Specifically, the secondary stabilizing arm 76 extends, preferably perpendicularly from the wall portion 34, 36 or in axial alignment with a second axis 78 defined by the secondary inserting arm 62 when inserted through the respective secondary aperture 74 therefor. The secondary stabilizing arm 76 is configured, for example positioned, sized and shaped, to adjacently abut the secondary inserting arm 62 when the secondary inserting arm 62 is inserted through the secondary aperture 74. Accordingly, the secondary stabilizing arm 76 limits the motion of, thereby stabilizing, the secondary inserting arm 62 when the secondary stabilizing arm 62 is inserted through the secondary aperture 74 when the spacer 10 is placed in the assembled configuration 38.

To provide further stabilization of the inserting arms 50, 62, each respective stabilizing arm 64, 76 has at least one stabilizing tab 80 extending generally perpendicularly from a stabilizing arm edge 82 thereof in the direction of the respective aperture 52, 74. The stabilizing tabs 80 are configured such that a respective inserting arm edge 112 of the inserting arm 50, 62 abuts the tab 80 when the inserting arm 50, 62 is inserted through the respective aperture 52, 74 and limits lateral movement of the inserting arm 50, 62 relative to the stabilizing arm 64, 76 and aperture 52, 74.

To facilitate retention and placement of the rod 12 in the saddles 18, and the cradle 40 formed thereby, when the spacer 10 is placed in the assembled configuration 38, the spacer 10 may, optionally, have a pair 86 of retaining arms 88. Preferably, and as shown in FIGS. 1 to 4, the spacer 10 will have two pairs 86*a*, 86*b* of retaining arms 88*a*, 88*b*. Each retaining arm 88 of each pair 86 extends adjacently proximal the saddle 18 from the inner wall 18 of a section 16, in proximity to a saddle edge 30, and away from the respective outer wall 20 thereof. Specifically, for each pair 86, a respective first retaining arm 88*a* thereof extends from the respective first wall portion 34 of one section 18 and a respective second retaining arm 88*b* thereof extends from the respective second wall portion 36 the other section 18. The respective retaining arms 86 are configured, and notably sized and shaped, to at least extend partially horizontally overlapping one another when the inserting ends 90 of the primary inserting arms 50 are introduced into the respective primary apertures 52 during connection of the sections 18 for placing the spacer 10 in the assembled configuration 38. The overlapping of the retaining arms 88 advantageously prevents accidental release of the rod 12 from the spacer 10, once the insert ends 90 are introduced into the apertures 52, during placement of the spacer 10 from the disassembled configuration 42 into the assembled configuration 38 by retaining a portion of the rod 12 extending between the retaining arms 88 in proximity to the saddles 26.

Preferably, each respective wall portion 34, 36 having a retaining arm 88 flares outwardly along a respective flaring edge 96 thereof which extends outwardly from a respective outer wall edge 98 of the respective outer wall 98 of the section 16 towards the respective saddle edge 30 adjacent to which the retaining arm 86 extends. The retaining arm 88, preferably, extends proximally adjacent both the flaring edge 96 and the saddle 26. Further, for each respective first wall portion 34 or each respective second wall portion 36 of one section 16 that has a retaining arm 88 extending therefrom, the opposing respective first wall portion 34 or second wall portion 36 situated directly opposite thereto on the other section 16 when the spacer 10 is in the assembled configuration 38 has a recessed edge 100. The recessed edge 100 extends from the saddle 26 intermediate the first and said second saddle edges 30*a*, 30*b* towards the respective outer wall 20 and is sized and shaped for allowing passage of the retaining arm 88 thereby in abutment therewith when the sections 16 are connected together in the assembled configuration 38.

As shown, the respective first retaining arm 88*a* and respective second retaining arm 88*b* of each pair 86 are, preferably, respectively situated on the first wall portion 34 of one section 16 and the second wall portion 36 of the other section 16, in proximity to the same saddle edge 30*a* or 30*b*. However, if desired, the first and second retaining arms 88*a*, 88*b* of a pair 86 could, respectively, extend in proximity to first saddle edge 30*a* and second saddle edge 30*b* of the two sections 16. Thus, the retaining arms 88*a*, 88*b* of a pair 86 could extend, from different sections 16*a*, 16*b*, in proximity to any one of the saddle edges 30*a*, 30*b*. Accordingly, although not shown, the respective first retaining arm 88*a* of a first pair 86*a* thereof and the respective first retaining arm 88*a* of second pair 86*b* thereof could extend, respectively, proximally adjacent the first respective saddle edge 30*a* and second respective saddle edge 30*b* of one section 16*a*. In such case, the respective second retaining arm 88*b* of the first pair 36*a* and the respective second retaining arm 88*b* of the second pair 86*b* would extend, respectively, proximally adjacent the respective first saddle edge 30*a* and respective second saddle edge 30*b* of the other section 16*b*. Conversely, the respective first retaining arm 88*a* of first pair 86*a* and the respective second retaining arm 88*b* of the second pair 86*b* could extend, respectively, proximally adjacent the respective first saddle edge 30*a* and the respective second saddle edge 30*b* of one section 16*a*. In such case, the respective first retaining arm 88*a* of the second pair 86*b* and the respective first retaining arm 88*b* of the second pair 86*b* would extend, respectively, proximally adjacent the second saddle edge 30*b* and the first saddle edge 30*a* of the other section 16*b*.

To further facilitate placement of the rod 12 in the saddles 26, each retaining arm 88 preferably has a guiding wall 92 facing towards the saddles 26 and which slants theretowards at an angle from a distal end 94 of the guiding wall 92, situated distal to the saddle 26, towards a proximal end 95 thereof situated proximal the saddle 26. The guiding walls 92, due to the slanting thereof towards the saddle 26, guide the rod 12 towards the saddles 26 as the sections 16 are pushed towards during extension of the arms 50, 62 through the apertures 52, 74, to place the spacer 10 in the assembled configuration 38.

To further enhance stability of the spacer 10 and retention of the sections 16 connected together in the assembled configuration 38, each retaining arm 88 has retaining arm teeth 102 and at least a portion of the recessed edge 100 has recessed edge teeth 104. The teeth 102, 104 are configured for releasable locking engagement with one another when the sections 16 are connected together in the assembled configuration 38.

While a specific embodiment has been described, those skilled in the art will recognize many alterations that could be made within the spirit of the invention, which is defined solely according to the following claims.

We claim:

1. A wheel spacer for mounting on a rod used in concrete item manufacture for spacing the rod from an object, said spacer comprising:

two sections, each section having a respective outer wall and a respective inner wall, said respective inner wall having respective first and second ends, a saddle situated substantially centrally between said respective first and second ends and extending towards said respective outer wall, and first and second wall portions connected by said respective saddle and extending therefrom respectively to said respective first and second ends, said respective outer wall extending generally circularly from said respective first end to said respective second end and forming a generally circular outer wheel structure when said first and second sections are connected to one another;

at least one primary inserting arm having primary inserting arm teeth protruding therefrom and extending from at least one of said respective first and second wall portions of one of said sections outwardly away from said respective saddle and said respective outer wall thereof;

for each primary inserting arm, on another of said sections, a respective primary aperture situated on said respective inner wall and a respective primary receiving arm, having primary receiving arm teeth, extending therefrom in proximity to said respective primary aperture towards said respective outer wall thereof, said respective primary aperture and said respective primary receiving arm being respectively situated on said respective first or second wall portion when said inserting arm is situated on said respective first or second wall portion, said respective primary arm aperture, said respective primary receiving arm, said primary inserting arm teeth and said primary receiving arm teeth being configured for insertion of said primary inserting arm through said respective primary aperture with said primary inserting arm teeth and said respective primary receiving arm teeth releasably lockingly engaging each other to releasably connect said sections together with the rod grippingly retained by said saddles and said outer wheel structure abutting the object to space the rod relative thereto at a substantially equal distance regardless of a position at which the object abuts said outer wheel structure;

at least one pair of retaining arms, each retaining arm extending adjacently proximal said respective saddle from one of said respective inner walls of one of said sections and away from said respective outer wall thereof, a respective first retaining arm of said pair extending from said respective first wall portion of one said section and a respective second retaining arm of said pair extending from said respective second wall portion of another said section, said respective retaining arms of each pair being configured to at least extend horizontally overlapping one another when said inserting arms are introduced into said respective primary apertures to maintain a portion of the rod extending between said respective retaining arms in proximity to said saddles as said sections are connected to one another;

wherein each saddle is defined by a saddle wall having generally longitudinally opposed respective first and second saddle edges and extending semi-circularly inwardly, between said respective first and second saddle edges, from said respective inner wall towards said respective outer wall from said respective first wall portion to said respective second wall portion, said retaining arms extending from said respective first and second wall portions proximally adjacent said saddle edges;

wherein, for each respective first wall portion or respective second wall portion of one section having one of said retaining arms extending therefrom, said respective first or second wall portions of another said section, generally opposite thereto when said sections are connected, having respectively a recessed edge extending from said saddle intermediate said first and said second saddle edges and sized and shaped for allowing passage of said retaining arm thereby while abutting therewith when said sections are connected.

2. The wheel spacer of claim 1, further comprising, for each section, a plurality of spaced apart protrusions protruding outwardly away from said respective outer wall thereof and facing away from said respective saddle thereof.

3. The wheel spacer of claim 1, further comprising, for at least one said section, at least one respective radial support arm, each respective radial support arm extending radially from said respective saddle to said respective outer wall intermediate said respective first and second ends.

4. The wheel spacer of claim 3, further comprising, for each respective radial support arm, at least one lateral support arm extending radially therefrom to one of said respective inner wall and an adjacent said respective radial reinforcing arm.

5. The wheel spacer of claim 1, wherein said at least one primary inserting arm comprises a first primary inserting arm and a second primary inserting arm, said first primary inserting arm extending from said respective first wall portion of one said section and said second primary inserting arm extending from said respective second wall portion of another said section.

6. The wheel spacer of claim 1, wherein, for each primary inserting arm and said respective primary receiving arm therefore, said primary inserting arm teeth and said primary receiving arm teeth face towards one another.

7. The wheel spacer of claim 1, further comprising at least one secondary inserting arm and a respective secondary aperture therefore, said secondary inserting arm extending from said respective inner wall of one said section oppositely away from said respective saddle thereof and said respective secondary aperture therefor being situated on said respective inner wall of another said section, said secondary inserting arm and said respective secondary aperture therefor being configured for insertion of said secondary inserting arm through said respective secondary aperture when said sections are connected by insertion of each primary inserting arm through said respective primary aperture therefor.

8. The wheel spacer of claim 7, further comprising, for each secondary inserting arm, a respective secondary stabilizing arm situated adjacent said respective secondary aperture and extending outwardly away from said respective inner wall of said section towards said respective outer wall thereof, said secondary stabilizing arm being configured for adjacently abutting said secondary inserting arm when said secondary inserting arm is inserted through said secondary aperture and limiting movement of said secondary inserting arm, thereby stabilizing said secondary inserting arm.

9. The wheel spacer of claim 1, further comprising for each primary inserting arm, a respective primary stabilizing arm extending from said respective inner wall of said section having said respective receiving arm towards said respective outer wall thereof proximally adjacent to said respective primary aperture in general axial alignment with a first axis defined by said respective primary receiving arm, said respective primary stabilizing arm being configured to adjacently abut said primary inserting arm on a respective first side thereof while said inserting arm is lockingly engaged, on a generally opposed respective second side thereof, by said respective primary receiving arm, thereby limiting motion of said primary inserting arm and stabilizing said primary inserting arm.

10. The wheel spacer of claim 1, wherein, for each pair of said retaining arms, said respective first retaining arm and said respective second retaining arm thereof extend, respectively, from said respective first wall portion and said second respective wall portion in proximity to one of said first and second said saddle edges.

11. The wheel spacer of claim 1, wherein said at least one pair of retaining arms comprises a first and a second pair of said retaining arms, said respective first retaining arm of said first pair and said respective first retaining arm of said second pair extending, respectively, proximally adjacent said first respective saddle edge and second respective saddle edge of one said section, said respective second retaining arm of said first pair and said respective second retaining arm of said second pair extending, respectively, proximally adjacent said respective first saddle edge and said respective second saddle edge of another said section.

12. The wheel spacer of claim 1, wherein said at least one pair retaining arms comprises a first and a second pair of said retaining arms, said respective first retaining arm of said first pair and said respective second retaining arm of said second pair extending, respectively, proximally adjacent said respective first saddle edge and said respective second saddle edge of one said section, said respective first retaining arm of said second pair and said respective second retaining arm of said second pair extending, respectively, proximally adjacent said second saddle edge and said first saddle edge of another said section.

13. The wheel spacer of claim 1, wherein each retaining arm has a guiding wall facing towards said respective saddle and which slants theretowards at an angle from a distal end of said guiding wall situated distal said saddle towards a proximal end thereof situated proximal said saddle for abutting said rod as said sections are connected and guiding said rod towards said respective saddle.

14. The wheel spacer of claim 1, wherein each retaining arm extends in proximity to a respective flaring edge of said first or second section from which said receiving arm extends, said respective flaring edge, and thereby said first or second wall having said respective flaring edge, flaring generally outwardly from said outer wall to one of said respective saddle edge proximal to which said respective retaining arm is situated.

15. The wheel spacer of claim 1, wherein each said retaining arm has retaining arm teeth and at least a portion of said recessed edge has recessed edge teeth, said retaining arm teeth and recessed edge teeth being configured for releasable locking engagement with one another when said sections are connected.

* * * * *